United States Patent [19]

Vijayendran

[11] 4,005,022

[45] Jan. 25, 1977

[54] ELECTROSTATIC LIQUID TONERS

[75] Inventor: Bheema R. Vijayendran, Bethel, Conn.

[73] Assignee: Pitney-Bowes, Inc., Stamford, Conn.

[22] Filed: Feb. 25, 1974

[21] Appl. No.: 445,612

[52] U.S. Cl. ..... 252/62.1 L; 96/1 LY

[51] Int. Cl.[2] ..... G03G 9/00

[58] Field of Search ..... 96/1 SD, 1 LY; 252/62.1; 117/37; 427/15, 17

[56] References Cited

UNITED STATES PATENTS

| | | | |
|---|---|---|---|
| 3,135,695 | 6/1964 | York | 252/62.1 |
| 3,516,934 | 6/1970 | Metcalte | 252/62.1 |
| 3,609,082 | 9/1971 | Moriconi | 252/62.1, |

FOREIGN PATENTS OR APPLICATIONS

| | | | |
|---|---|---|---|
| 630,698 | 4/1963 | Belgium | 252/62.1 |

*Primary Examiner*—David Klein
*Assistant Examiner*—John L. Goodrow
*Attorney, Agent, or Firm*—Peter Vrahotes; William D. Soltow, Jr.; Albert W. Scribner

[57] ABSTRACT

Disclosed herein are novel liquid toner compositions that are suitable for developing electrostatic images. The toner compositions of the present invention comprise pigment, dye, and a polymer, the combination being suspended in an aliphatic saturated hydrocarbon. The improvement in the performance of these toners is due to the presence of small, but significant amounts of dyes which are capable of modifying the surface characteristics of the toner pigment particles.

2 Claims, No Drawings

ELECTROSTATIC LIQUID TONERS

BACKGROUND OF THE INVENTION

In electrostatic printers, a sheet having a photoconductive layer is given an electrostatic positive or negative charge in the dark, such as by means of a corona-charging device. The charge layer is then exposed to a light image of an original document to cause the charge on the layer to leak off in non-image areas and selectively leave a latent electrostatic charge image. This latent image is then developed by applying to the photoconductive layer a toner containing particles which have a charge opposite to the residual electrostatic charge image so that the toner particles adhere to the charged areas and form an image. In order to function properly for this purpose, the toner must be capable of producing a colored layer of suitable density on the charged areas without unduly coloring the uncharged or background areas. Although there are many liquid toners which serve satisfactorily in the electrophotographic production of copies, each generally has a drawback, such as bad effect on the background, low stability and poor ability to produce sharp black copies at a reasonable cost.

SUMMARY OF THE INVENTION

An electrostatic liquid toner is prepared by dispersing in a mill a mixture of a toner pigment, a polymer, and a compound which has the ability to modify the surface characteristics of the toner pigment. This mixture is then suspended in an aliphatic saturated hydrocarbon carrier which has an electrical resistivity of at least $10^{10}$–$10^{14}$ ohm-centimeters. The surface modifying compound is selected so that it does not adversely affect the electrical characteristics of the carrier.

DETAILED DESCRIPTION OF THE INVENTION

The widely used process of liquid development of latent electrostatic images depends mainly on the electrophoretic property of the toner particles. "Electrophoresis" is understood to mean the relative mobility of suspended particles with respect to its suspending medium in an electric field. The mobility of the toner particles is brought about because these particles carry an electric charge. In some cases, the mobility is due to dielectrophoresis which is due to the effect of non-homogenous field on the particles. It is well recognized in the art that for the satisfactory performance of toners the above-mentioned charge and the related mobility is of paramount importance. However, the actual mechanism responsible for the charging of the toner particles is not well understood. Small solid particles in a low dielectric constant and high resistive liquid, may be charged by triboeletric effects, contact potential differences, boundary layer effects, etc. It is also possible that polymeric binders, resins and other agents such as metal soaps, which are invariably used in liquid toner compositions can dissolve to a limited extent in the low polar solvent and form ions or charged molecules, and the preferential adsorption of such dissolved molecules on the toner particle can create a net charge on the particles.

It is well known in colloidal systems that the interface between the solid and liquid undergoes charge distribution (so called electrical double layer) whenever there is a preferential adsorption of a charged ion/molecule from the bulk solution. Whatever the actual mechanism of charging of particles may be, it is clear that the solid/liquid interface is very instrumental in creating a charge for the toner particle. In this invention, we show that by modifying the surface characteristics of the toner particles we can affect the solid/liquid interface in such a way to make toners with improved properties. The improvement lies in obtaining toners with sufficient charge so that the developed images are sharp, well filled in and have no background. It is obvious that toners having variously charged particles — some positive, negative or neutral — would be totally unacceptable for making electrostatic copies.

Another important requirement for a good liquid toner is its stability towards settling. Again, the understanding of stability of a colloidal system in a low polar solvent is not complete, even though coonsiderable progress had been made in the recent years. According to the current theories of colloidal stability, the stability of any suspension is controlled by two main factors, namely: steric or entropic stabilization and electrostatic repelling of the charged particles. However, there would be other factors such as enthalpic and osmotic effects. The entropic repulsion results from the preferential adsorption of the dissolved ions/molecules on to the surface of the toner particle. The electrostatic repulsion due to the residing electric charges on the particles as explained above is dependent on the nature of the solid particle/liquid interface. Again, by the same surface modification of the toner particle mentioned above we have been able to substantially improve the stability of the toners towards settling.

Most of the toners used in commercial electrostatic copiers contain solid pigments, polymeric binders and so called charge directors such as metal soaps, oils, natural products, etc. in a low polar solvent. The pigment is the solid surface of the toner particle and is usually some kind of carbon black. There may be some blue pigment in the formulation to tint the image. It has been found that performance and properties of such black electrostatic toners based upon carbon black can be improved by modifying the surface characteristics of the carbon black by using certain compounds.

The carbon black particle surface has a very definite chemical and physical characteristic. Chemistry and Physics of Carbon, Edited by Philip L. Walker, Jr., vol. 6, 1970, has a very extensive treatment on the surface characteristics of carbon black. Most of the carbon blacks contain chemical groups such as quinones, lactones, ethers, and the like which are capable of adsorbing organic compounds. The preferential adsorption at the carbon black/solution interface is supposed to be brought about by the chemical/physical forces such as dipole-dipole, induced dipole-dipole, interactions, etc., existing between the abovementioned groups on the carbon black surface and the dissolved organic compound in the low polar solvent. Such interactions are known to be weak singly, but cooperative in action and are quite strong in organic molecules containing polarizable electrons such as pielectrons. Hence, it is reasonable to expect that organic molecules containing several polarizable electrons such as those having polynuclear benzene rings, should modify the surface of carbon black most. After screening more that thirty potential candidates we found that the organic compound should have all of the following properties, to be used advantageously in modifying the surface characteristic of the carbon black.

i. It should contain at least three benzene rings in the molecule. Examples of these are 1,10 ortho penonthrolene, azo dyes, and triphenyl methane dyes.

ii. It should be soluble enought in the low polar solvent to bring about the preferential adsorption and hence the desired surface modification of the toner particle. However, the solubility should be such that condition (iii) is still satisfied.

iii. The solubility of these modifying compounds should not increase the specific conductance of the low polar solvent above $7\times10^{-10}$ or below $10^{-12}$ mhos/cm.

By way of specific example, some of the surface modifying compounds which have the required characteristics are the following dyes: Sudan Deep Black, Sudan Green 4B, Bismarck Brown, and Sudan Blue, all manufactured by GAF Corporation, and 1,10 ortho phenanthroline. Some materials which were included in this screening which were not found acceptable include the following: pyridine, 2-2′ dipyridyl, triphenyl triazine diphenyl amine, quinoline-2 methyl, 1,4 benzo diazine, 1,3-di 4 piperidyl propane, N,N-dimethyl naphthylamine, 2,3 diphenyl quinoxaline, Basic Yellow No. 2 C.I. 41000 (Auramine OS extra, GAF), Basic Orange No. 1 C.I. 11320 (Chrysoidine RRS, GAF), Basic Violet 1 C.I. 42535 Methyl Violet XXA (GAF), Basic Red 2 C.I. 50240 (Saframine T Extra, Dupont) and Basic Red 12 Paper Red P solution C.I. 48070 (Dupont). Although Basic Red 2 C.I. 50240 has three benezene rings, it lacked the solubility and electrical characteristics required.

Through the use of these chemical compounds that are capable of modifying the surface characteristics of the toner pigment, it has been found that improved liquid toners are achieved.

The toner pigment, such as nigrosine, channel black and carbon black, should be of particularly fine particle size, preferably not greater than about 35 milimicrons particle diameter as measured by electron microscopy. In addition, the pigment should have a volatile content of 2 to 10% and a pH of 3.0 to 5.0 which are a measure of the above mentioned oxygen complexes on the carbon black surfaces which are capable of adsorbing the surface modifying compounds. Examples of such pigments are Mogel L, Regal 400 R and Monarch 71, manufactured by Cabot Corp. and Raven 35 Super Spectra, Excelsior and Peerless 155, manufactured by Columbia Carbon Co.

The carrier liquid should be an aliphatic saturated hydrocarbon fluid, it having been discovered that this particular class of carriers is uniquely capable of effecting the present invention by virtue of the following attributes: (a) quick evaporation, e.g., a thin film of the carrier will evaporate in a few seconds at a temperature below the char point of paper, so as to permit fast drying: (b) non toxicity; (c) low odor; (d) sufficient fluid to allow the dispersed particles to migrate therethrough with ease so that they are capable of being quickly electrostatically attracted to and coupled with the pattern of electrostatic charges which is to be developed; (e) non attaching to the binder or other ingredients of the photoconductive coating on a lithographic master; (f) non bleeding to the electrostatic charges before the particle is deposited so as to maintain any desired degree of contrast; and (g) inexpensiveness.

In order to obtain these beneficial attributes, the petroleum fraction, as for example, paraffinic solvent and isoparaffinic solvent should have an evaportion rate at least as fast as that of kerosene, but slower than that of hexane. Thereby, the evaporation of the liquid from a film will be rapied, e.g., two seconds, or less, at a temperature below the char point of paper, it being customary to raise the temperature of the film of liquid developer to this level for the purpose of evaporating the developer after the electroscopic particles of the toner have been deposited by attraction on the electrostatically charged pattern. The aliphatic saturated hydrocarbon should have a low K.B. (Kauri-butanol) number, to wit, less than 35, and preferably between 25 and 35. This low K.B. number minimizes the possibility that the petroleum fraction will attack the coating binder, e.g., the binder for the zinc oxide. The aliphatic saturated hydrocarbon also should be substantially free of aromatic liquid constituents, i.e., it should be substantially aromatic-liquid-free. This term as used herein, connotes that the proportion of aromatic liquids in the organic liquid carrier should not be in excess of approximately 2 percent by weight. The aromatic liquids have a strong tendency to attack the coating binders, e.g., the coating binders for zinc oxide, but in concentrations of less than two percent this tendency is so negligible as to be unnoticeable. The aliphatic saturated hydrocarbon must have a high electrical resistivity, e.g., in the order of at least $10^{10}$–$10^{14}$ ohm centimeters, and a dielectric constant of less than 3.5 so that the liquid carrier will not dissipate the pattern of electrostatic charges which are to be developed. the TCC (Tagliabue closed cup) flash point of the liquid carrier should be at least 100° F (38° C) whereby under the conditions of use the liquid is considered nonflammable. The paraffinic and isoparaffinic solvents are nontoxic and possess no ojectionable odor, this being denoted by the term "low odor."

Consonant with its low dielectric constant and high resistivity, the liquid carrier is non-polar. The petroleum fractions have two other advantages of low viscosity and inexpensiveness.

Examples of aliphatic saturated hydrocarbon having physical characteristics which fall within the foregoing criteria are Isopar G manufactured by Exxon Corporation and Soltrol 100 manufactured by Phillips Petroleum.

The polymeric material must be soluble in the aliphatic saturated low K.B. solvent hydrocarbon fluid and is preferably an acrylic polymer, and olefinalkylated polyvinylpyrrolidone or a beta-piene having a high degree of affinity for absorption on the pigment. Examples of such polymeric materials are Neocryl B-707, a terpolymer composed of vinyl toluene, i-butyl methacrylate and lauryl or stearyl methacrylate, manufactured by Polyvinyl Chemicals, Inc.; Ganex 216 an alkylated vinylpyrrolidone manufactured by GAF Corp.; Pliolite CPR, an acrylic modified vinyl tobuene manufactured by Goodyear Corp.; and Gammaprene A-115 beta-pienene manufactured by Reichold Chemicals, respectively. Throughout this specification, including the appended claims, the term organic polymer is used to specify a polymeric material soluable in a low K.B. solvent.

From the experiments that are illustrated in the examples given hereinafter, and other experiments, it was found that the toner of this invention may be produced as follows:

Preparing a concentrate by blending 2–15% toner pigment, 10–50% of a polymer which is soluble in an aliphatic saturated hydrocarbon, and 45–75% aliphatic saturated hydrocarbon having a petroleum fraction with a film evaporation of less than two seconds, at a temperature below the char point of paper, and a K.B. number of less than 30. Optionally, 0.5 to 3% of a color modifying pigment such as a dye mode be added to the concentrate. All percentages are weight percent.

An intensifier is then prepared by adding 3–20 parts of the above concentrate to 80–97 parts of the aliphatic saturated hydrocarbon containing 1–10 parts of a charge director.

The toner is produced by adding 1–10 parts of the above intensifier to 90–99 parts of the aliphatic saturated hydrocarbon.

EXAMPLE I

An electrostatic liquid toner embodying the principals of this invention was prepared by initially making a concentrate having the following formulation:

| | |
|---|---|
| Mogul L Carbon Black (Cabot Corp.) | 12.0 gm |
| Alkali Blue G (Allied Corp.) | 2.0 gm |
| Sudan Black BR (GAF Corp.) | 1.0 gm. |
| Neocryl B 707 (Polyvinyl Chemicals) | 160.0 gm |
| Isopar G (Exxon Corp.) | 210.0 gm |

This concentrate was then made into an intensifier by adding to 532 grams of Isopar G, 8 grams of Zirconium and 20 grams of the concentrate. This was blended for 15 minutes.

From this intensifier, a toner was prepared by adding to 3,000 cc of Isopar G, 632 cc of the above intensifier.

This liquid toner was then used in a Model 260 copier manufactured by Pitney-Bowes, Inc. and a number of copies were made. It was found that the copies achieved high contrast, good resolution, low background coloration, and uniform results copy to copy. Additionally, it was found that the toner has a high shelf for the same was inspected after nine months and found to have no deterioration.

EXAMPLES 2–11

The above formulations were repeated with the exception that the Sudan Black BR was replaced by the following compositions having the indicated color index (CI):

| | |
|---|---|
| Sudan Red | CI 26120 |
| Methylviolet Base A | CI 42535B |
| Victoria Blue BA Base | CI 44045B |
| Sudan Blue GA | CI 61525 |
| Sudan Green 4B | CI 61565 |
| Victoria Green Base | CI 42000B |
| Bismarck Brown TSS Base | CI 21010B |
| Sudan Brown 5BA | |
| Sudan Black CRA | |
| Sudan Deep Black BN | CI 26150 |

All of the above dyes are manufactured by and are trademarks of GAF Corporation, the color index number being given when available. Each of the toners made with one of the above enumerated dyes was used in a 260 copier and from 50 to 100 copies were made with each toner. Again, it was found that each of the above dyes when used in a toner as exemplified yielded good results.

It has been found experimentally that the quantity of dye added to the original concentrate should be in the order of 0.03 grams to 6 grams per liter of solvent. The optical density of the resulting toner had been adjusted to be from 0.3 to 1.1 at 600 milimicrons measured using a 1 mm path length.

EXAMPLE 12

A concentrate was prepared from the following ingredients:

| | |
|---|---|
| Raven - 35 (Columbian Carbon) | 12.0 parts |
| Alkali Blue - G (Allied Chem.) | 2.0 parts |
| Sudan Green 4B (GAF Corp.) | 1.0 parts |
| Neocryl B707 (Polyvinyl Chem.) | 160.0 parts |
| Soltrol - 100 (Phillips Petroleum) | 210.0 parts |

The concentrate was made in a sand mill. The concentrate was made into an intensifier by taking 5 grams of the above concentrate and mixing with 8 grams of Zirco (6% Zirconium metal content) from Tenneco Chemicals and 127 grams of Soltrol-100.

The toner was made by taking 1 part of the above intensifier and mixing with 9 parts of Soltrol-100.

EXAMPLE 13

A concentrate was prepared by blending the following ingredients:

| | |
|---|---|
| L-31 Codispersion (Columbian Carbon) 50% solids content made from furnace black of particle size - 65 milimicrons | 90 gms |
| Alkali Blue - A (Allied Chemical) | 0.15 gms |
| 1,10 orthophenanthroline | 1.5 gms |
| Goodyear Pliolite CPR 5014 resin (50% solids in odorless mineral spirits Acrylics modified vinyl toluene resin) | 206 gms |
| Zirco (6% Zr metal from Tenneco) | 25 gms |
| Soltrol - 100 | 225 gms |

The concentrate was made by mixing the above in a high speed dispenser for 30 minutes. An intensifier was prepared by taking 20 parts of the above and mixing with 80 parts Soltrol-100. The toner was prepared by taking 40 grams of the above intensifier and mixing it in one gallon of Soltrol-100.

EXAMPLE 14

A concentrate was prepared from the following ingredients:

| | |
|---|---|
| L-31 Codispersion (Columbian Carbon) | 48 grams |
| Alkali Blue | 1.5 grams |
| Sudan Blue GA (GAF Corp.) | 0.75 grams |
| Gammaprene A-115 Resin (δ-pienene type resins from Reichhold Chemical) | 60 grams |
| Soltrol - 100 | 113 grams |

A concentrate was prepared as described in Example 13. An intensifier was made by mixing 20 grams of the concentrate with 5 grams of Zirco (6% Zirconium metal content) and 75 grams of Soltrol-100. A toner was made by taking 25 grams of the intensifier and mixing with one gallon of Soltrol-100.

What is claimed is:

1. In a liquid toner having as ingredients particles of carbon black pigment, aliphatic saturated hydrocarbon solvent and a resin soluble in the aliphatic saturated hydrocarbon, the improvement comprising: increasing the electrophoretic property of the carbon pigment particles by modifying the pigment surface with an organic modifying agent capable of modifying the carbon surfaces through doner/acceptor electron interactions by having a molecule structure containing at least three benzene rings and having a solubility of 0.03 to 6 grams per liter in the aliphatic saturated hydrocarbon solvent.

2. The toner of claim 1 wherein the surface modifying agent is selected from the group consisting of azo dye, triphenyl methane, and 1,10 orthophenenthroline.

* * * * *